US012383816B2

(12) United States Patent
Chen

(10) Patent No.: US 12,383,816 B2
(45) Date of Patent: Aug. 12, 2025

(54) SLIDING PUZZLE

(71) Applicant: MODOU TECHNOLOGY (ZHONGSHAN) CO., LTD., Zhongshan (CN)

(72) Inventor: Yong Chen, Zhongshan (CN)

(73) Assignee: MODOU TECHNOLOGY (ZHONGSHAN) CO., LTD., Zhongshan (CN)

( * ) Notice: Subject to any disclaimer, the term of this patent is extended or adjusted under 35 U.S.C. 154(b) by 0 days.

(21) Appl. No.: 18/517,175

(22) Filed: Nov. 22, 2023

(65) Prior Publication Data

US 2025/0073569 A1 Mar. 6, 2025

(30) Foreign Application Priority Data

Sep. 5, 2023 (CN) ..... 202322410015.2

(51) Int. Cl.
*A63F 9/08* (2006.01)

(52) U.S. Cl.
CPC ..... *A63F 9/0811* (2013.01); *A63F 2009/0815* (2013.01)

(58) Field of Classification Search
CPC ..... A63F 9/0811; A63F 2009/0815; A63F 9/083; A63F 9/0857; A63F 9/0865
See application file for complete search history.

(56) References Cited

U.S. PATENT DOCUMENTS 4,872,682 A * 10/1989 Kuchimanchi ..... A63F 9/083 273/153 S
4,949,969 A * 8/1990 Johnson ..... A63F 9/001 273/153 R
5,074,561 A * 12/1991 Johnson ..... A63F 9/083 273/153 S
5,116,053 A * 5/1992 Blankenburg ..... A63F 9/0811 273/153 S (Continued)

FOREIGN PATENT DOCUMENTS

DE 9309506 U1 * 4/1994
DE 202011004711 U1 * 8/2012 ..... A63F 9/083

(Continued)

*Primary Examiner* — Steven B Wong
(74) *Attorney, Agent, or Firm* — HOWARD M COHN and Associates, LLC

(57) ABSTRACT

The present disclosure provides a sliding puzzle. The sliding puzzle includes a cylindrical support and a plurality of blocks. The cylindrical support provided with two opposite bottom surfaces and a side surface connected between the two bottom surfaces, wherein the side surface is provided with a guide rail structure. Each of the blocks is mounted on the guide rail structure and can slide along the guide rail structure to change a position. The sliding puzzle in this solution can effectively decrease the possibility of loss of block parts in an assembling process of the sliding puzzle and improves the convenience of use of the sliding puzzle. Meanwhile, compared with the paper card type and plastic sliding puzzles, the sliding puzzle in this solution improves the stereo perception and the funniness. The sliding puzzle is simple in structure, convenient to assemble, and connected firmly.

18 Claims, 10 Drawing Sheets

(56) References Cited

U.S. PATENT DOCUMENTS

| | | | | | |
|---|---|---|---|---|---|
| 5,429,364 | A * | 7/1995 | Chang | A63F 9/083 | 273/153 S |
| 5,845,904 | A * | 12/1998 | Hawkins | A63F 9/0811 | 273/153 S |
| D532,834 | S * | 11/2006 | Chuang | D21/478 | |
| 7,147,224 | B2 * | 12/2006 | Chuang | A63F 9/083 | 273/153 S |
| 8,251,366 | B1 * | 8/2012 | Nathan | A63F 9/0811 | 273/153 S |
| 8,302,967 | B2 * | 11/2012 | Kim | A63F 9/0826 | 273/153 S |
| 8,360,432 | B2 * | 1/2013 | Hjerppe | A63F 9/083 | 273/153 S |
| 8,387,984 | B2 * | 3/2013 | Artsiely | A63F 9/0823 | 273/153 S |
| 2003/0155709 | A1 * | 8/2003 | Han | A63F 9/083 | 273/153 S |
| 2003/0227131 | A1 * | 12/2003 | Han | A63F 9/083 | 273/153 S |
| 2006/0061033 | A1 * | 3/2006 | Han | A63F 9/083 | 273/153 S |
| 2007/0164514 | A1 * | 7/2007 | Chuang | A63F 9/10 | 273/157 R |
| 2016/0151719 | A1 * | 6/2016 | Pijanowski | A63H 33/003 | 446/71 |
| 2016/0263475 | A1 * | 9/2016 | Shih | A63F 9/0857 | |

FOREIGN PATENT DOCUMENTS

| | | | | |
|---|---|---|---|---|
| GB | 2182855 A * | 5/1987 | A63F 9/083 | |
| GB | 2481652 A * | 1/2012 | A63F 9/0857 | |

* cited by examiner

SLIDING PUZZLE

CROSS-REFERENCE TO RELATED APPLICATIONS

The application claims priority of Chinese patent application CN202322410015.2, filed on Sep. 5, 2023, which is incorporated herein by reference in its entireties.

TECHNICAL FIELD

The present disclosure relates to the field of toys, and in particular, to a sliding puzzle.

BACKGROUND

Sliding puzzle is played by dividing a pattern into several small square blocks with equal sizes, removing one or more of the small square blocks to form missing parts, and sliding other small square blocks using an extra space to disarrange the pattern to form a puzzle. The playing rule is that any small square block cannot be removed during disarrangement or resetting, and the small square blocks in the pattern are slid using the missing parts to restore the pattern. Common sliding puzzles include paper card type sliding puzzles and plastic sliding puzzles, which do not have a stereo perception during playing and are less funny. However, some rare sliding puzzles with stereo perceptions are mostly assembled by a plurality of blocks that are fixed on a surface of a main body seat through buckles or in a magnetic suction manner. According to this sliding puzzle, puzzle components are easy to lose in the assembling process, which reduces the convenience of use of the sliding puzzle. In addition, in the production and assembling process, this kind of toy is difficult to assemble and has low mounting efficiency due to a large quantity of blocks which need to be arranged. As a result, the production cost is high.

SUMMARY

In view of this, it is necessary to provide a sliding puzzle with good user experience, simple assembling, and case of popularization and application.

The present disclosure provides a sliding puzzle, including: a cylindrical support, provided with two opposite bottom surfaces and a side surface connected between the two bottom surfaces, wherein the side surface is provided with a guide rail structure; and a plurality of blocks, wherein each of the blocks is mounted on the guide rail structure and can slide along the guide rail structure to change a position.

It can be understood that according to the sliding puzzle of the present disclosure, the guide rail structure is arranged on the cylindrical support, and the plurality of blocks slide along the guide rail structure to change the positions. Compared with the sliding puzzle in the prior art, which is assembled by fixing the plurality of blocks to a surface of a main body seat one by one through buckles or in a magnetic suction manner, the sliding puzzle in this solution can effectively decrease the possibility of loss of block parts in an assembling process of the sliding puzzle and improves the convenience of use of the sliding puzzle. Meanwhile, compared with the paper card type and plastic sliding puzzles, the sliding puzzle in this solution improves the stereo perception and the funniness. Furthermore, the plurality of blocks and the cylindrical support are only connected through the guide rail structure, so that the sliding puzzle is simple in structure, convenient to assemble, and connected firmly.

In one embodiment, the guide rail structure includes chutes; the cylindrical support includes a support main body, a connecting part, and a plurality of curved plates; the support main body is a cylindrical body and has an outer circumferential surface with an arc-shaped cross section; the connecting part is connected between the outer circumferential surface and the curved plates; the plurality of curved plates are located on an outer side of the outer circumferential surface and protrude towards the outer side of the outer circumferential surface; surfaces, far from the outer circumferential surface, of the plurality of curved plates define the side surface, and the chutes are located between two adjacent curved plates; each block includes a block part and a sliding part connected to one side of the block part close to the cylindrical support; and the sliding part is at least partially located in the chute and slides along the chute. It can be understood that the cylindrical support includes the support main body, the connecting part, and the plurality of curved plates, so that the cylindrical support can be independently and separately manufactured during early production, thereby facilitating respective molding in production process and improving the convenience of production and manufacturing of the cylindrical support. In case of a damage in a later stage, respective damaged components can be removed for replacement to avoid replacement of the entire toy due to the local damage.

In one embodiment, the sliding parts are provided with sliding slots; and the curved plates are at least partially mounted in the sliding slots, so that the blocks can slide along the curved plates and change the positions. It can be understood that only by cooperation between the sliding slots and the curved plates, the blocks can slide correspondingly on the guide rail structure, thereby improving the convenience of assembling and disassembling and the flexibility of sliding of the sliding puzzle. The curved plates are at least partially mounted in the sliding slots, without any fasteners and mounting holes, which further simplifies the assembling process and also facilitates smooth sliding of the blocks on the guide rail structure, so that it is very flexible for a pushing operation. Meanwhile, the blocks and the curved plates are detachably connected, so that when the blocks are damaged and need to be replaced, the curved plates can be removed for replacement. This avoids such the phenomenon that the entire sliding puzzle needs to be replaced due to the local damage of the blocks, thus reducing the cost of replacement of the sliding puzzle.

In one embodiment, each sliding part includes a first portion and a second portion; the first portion is located on one side of the block part close to the cylindrical support and is opposite to the block part; the second portion is connected between the block part and the first portion; and the first portion, the block part, and the second portion are enclosed to form the sliding slot located between the block part and the first portion. An extending slot communicated with the chute is further formed between each curved plate and the outer circumferential surface; the first portion is located in the extending slot; the connecting part is connected to a middle region of the curved plate; the second portion is connected to a middle region of the block part and a middle region of the first portion; the block part is in a curved plate shape protruding towards one side far from the cylindrical support; the first portion is in a curved plate shape protruding towards one side far from the block part; a size of the first portion is smaller than a size of the block part; a size of the curved plate is larger than the size of the first portion and smaller than the size of the block part; a first gap is reserved between the first portion and the connecting part; and a second gap is reserved between the curved plate and the second portion. It can be understood that the arrangement of the extending slots reduces a frictional force formed by relative sliding between the blocks and the chute and can improve the smoothness of movement of the blocks.

In one embodiment, the plurality of curved plates are arranged in an array; the chutes include a plurality of first chutes parallel to a central axis of the cylindrical support and a plurality of second chutes vertically intersected with the first chutes and annularly arranged along the side surface of the cylindrical support. It can be understood that the curved plates are arranged in the array, which simplifies the complexity of the assembling of the blocks. Through the arrangement of the first chutes and the second chutes, a guide effect is achieved on the sliding of the blocks, so that a sliding path can be formed along the first chutes and the second chutes, and the blocks rotate at a periphery of the cylindrical support and moves up, down, left, and right, thus ensuring the stability of the blocks in the sliding process.

In one embodiment, the blocks are located on an outer side of the side surface and protrude towards the outer side of the side surface; surfaces of the blocks far from the side surface are an arc-shaped surfaces; the sliding puzzle is of a cylindrical structure; and the arc-shaped surfaces of the plurality of blocks are enclosed to form an outer side surface of the cylindrical structure. The plurality of blocks are arranged in an array with a missing part; each block includes two first straight edges which extend in a direction where the first chute is located and are arranged in a manner of being opposite to each other, and first arc-shaped edges which extend in a direction where the second chute is located and are arranged in a manner of being opposite to each other; and each curved plate includes two second straight edges which extend in the direction where the first chute is located and are arranged in a manner of being opposite to each other, and second arc-shaped edges which extend in the direction where the second chute is located and are arranged in a manner of being opposite to each other. It can be understood that the first straight edges of the blocks are matched with the second straight edges of the curved plates, and the first arc-shaped edges of the blocks are matched with the second arc-shaped edges of the curved plates. This arrangement can enlarge an abutment area between the blocks and the curved plates, thereby improving the stability of connection between the blocks and the curved plates and further reducing the possibility that the blocks are separated from the cylindrical support because the blocks are separated from the curved plates during the use of the sliding puzzle.

In one embodiment, distances between the plurality of first chutes are equal; distances between the plurality of second chutes are equal; the plurality of blocks have same sizes; the plurality of curved plates have same sizes; the size of the block is greater than the size of the curved plate; the plurality of first chutes have same sizes; the plurality of second chutes have same sizes; and widths of the plurality of first chutes are equal to widths of the plurality of second chutes.

In one embodiment, the cylindrical support further includes mounting covers mounted on two sides of the support main body; the mounting covers are provided with first detachable structures; the support main body is provided with a second detachable structure; and the first detachable structures are detachably connected to the second detachable structure, so that the mounting covers are detachably connected to the support main body into a whole. It can be understood that due to the design of the mounting covers, the blocks can slide on the support main body without sliding out, which maintains the overall stability of the sliding puzzle, and the mounting covers are detachably connected to the support main body, which facilitates later production and repair.

In one embodiment, each mounting cover includes a circular substrate, a first side wall part connected to one side of the substrate and arranged around the central axis of the cylindrical support, and a second side wall part connected to one side of the substrate, arranged around the first side wall part, and spaced part from the first side wall part; an inner surface of the first side wall part is provided with the first detachable structure; the support main body includes a third side wall part arranged around the central axis of the cylindrical support; and an outer surface of the third side wall part is provided with the second detachable structure.

In one embodiment, the support main body is of a hollow structure; the curved plates close to the mounting covers are located in a space between the first side wall parts c and the second side wall parts; outer diameters of the second side wall parts are less than a diameter of the substrate, so that a surface of one side of the substrate close to the support main body and outer surfaces of the second side wall parts are enclosed into stepped storage parts; and the blocks close to the mounting covers are located in the storage parts. It can be understood that the support main body is of the hollow structure, which can reduce the mass of the support main body and make it easy for the user to carry, and can also reduce use of production materials to reduce the manufacturing cost.

In one embodiment, each mounting cover further includes a decorative plate; and the decorative plate is covered at one end of the second side wall part far from the support main body to cover the substrate. Through the arrangement of the decorative plate, the substrate can be covered, so that the product has a more beautiful appearance, and debris can be effectively prevented from entering the product.

In one embodiment, each sliding part is provided with a groove on a surface close to the sub-support of the cylindrical support; each block part is provided with a plurality of convex blocks on one side close to the sub-support; and the respective convex blocks are respectively adjacent to four corners of the block part. The groove is arranged on the surface of the sliding part, which can achieve a certain gap between the sliding part and the sub-support, reduce the friction, and facilitate the sliding of the sliding part. Meanwhile, the convex blocks are arranged on the block part, which can add a gap from the curved plate and reduce a contact area, thereby reducing the friction, facilitating the sliding of the sliding part, and improving the experience.

In one embodiment, the cylindrical support includes at least two sub-supports, and at least two sub-supports are detachably connected with each other to form the cylindrical support. The cylindrical support is divided into at least two sub-supports, which can effectively reduce a volume of the cylindrical support, which facilitates transferring and mounting operations. During assembling, after one sub-support is mounted, the blocks are assembled to the guide rail structure; and afterwards, the sub-supports and the blocks are repeatedly assembled. As the sub-supports are diminished, the guide rail structures also change, which avoids long-distance sliding and arrangement of the blocks on the guide rail structures during the assembling, thus improving the assembling efficiency of the blocks and effectively reducing the production cost of the product.

In one embodiment, the respective sub-supports have same structures; the sub-supports are of cylindrical structures; and the sub-supports are connected in a direction where the central axis of the cylindrical support is located to form the cylindrical support. Due to the design of the sub-supports having the same structures, the production is facilitated, and differentiation is not required during assembling, thereby improving the production efficiency and assembling efficiency and reducing the production cost of a product.

In one embodiment, the sub-supports are further provided with third detachable structures, and the third detachable structures of two adjacent sub-supports are detachably connected to enable the respective sub-supports to be connected to form the cylindrical support. Through the arrangement of the third detachable structures, the two sub-supports can be connected to obtain the cylindrical support; and the assembling and disassembling are simple and convenient, thereby improving the assembling efficiency of the product, effectively reducing the production cost, and improving the competitiveness of the product.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
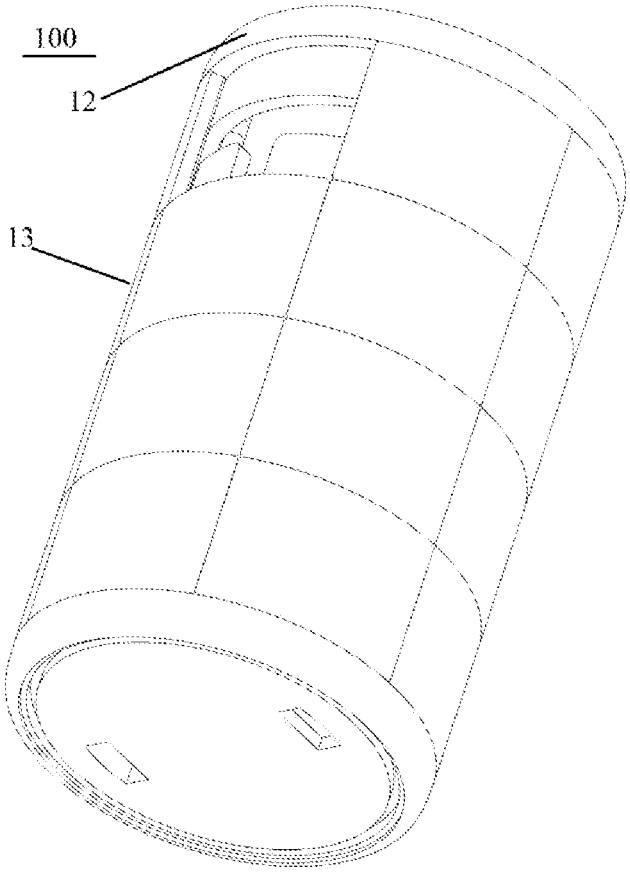
FIG. 1 is a three-dimensional diagram of a sliding puzzle according to Embodiment I of the present disclosure.

In order to facilitate understanding the present disclosure, the present disclosure will be described more comprehensively below with reference to related accompanying drawings. Preferred implementations of the present disclosure are provided in the drawings. However, the present disclosure can be implemented in many different forms, and are not limited to the implementations described herein. On the contrary, these implementations are provided to make the content disclosed in the present disclosure understood more thoroughly and comprehensively.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Unless otherwise defined, all technical and scientific terms used herein have the same meaning as those commonly understood by a person skilled in the art to which the present disclosure belongs. Terms used in the specification of the present disclosure herein are merely intended to describe objectives of the specific embodiments, but are not intended to limit the present disclosure. The term "and/or" used herein includes any and all combinations of one or more related listed items.

Embodiment I

Figure 2:
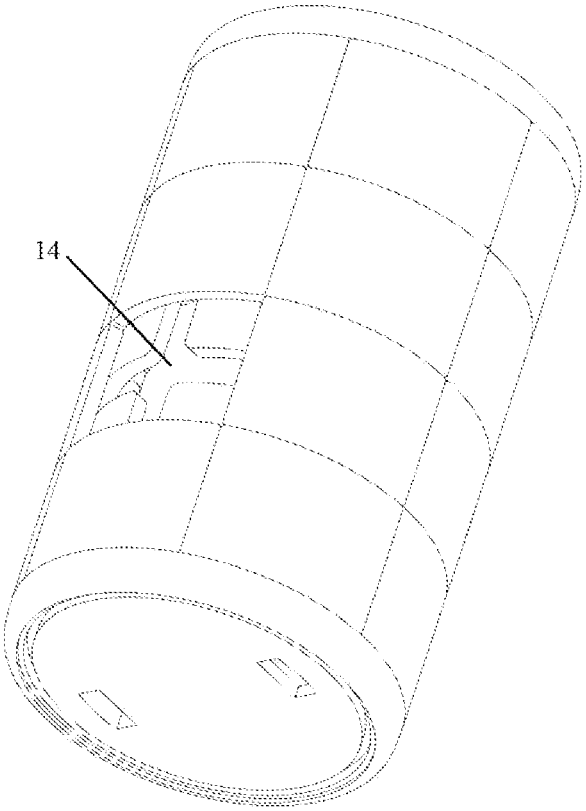
FIG. 2 is a three-dimensional diagram of a changing state of the sliding puzzle shown in FIG. 1.
Figure 3:
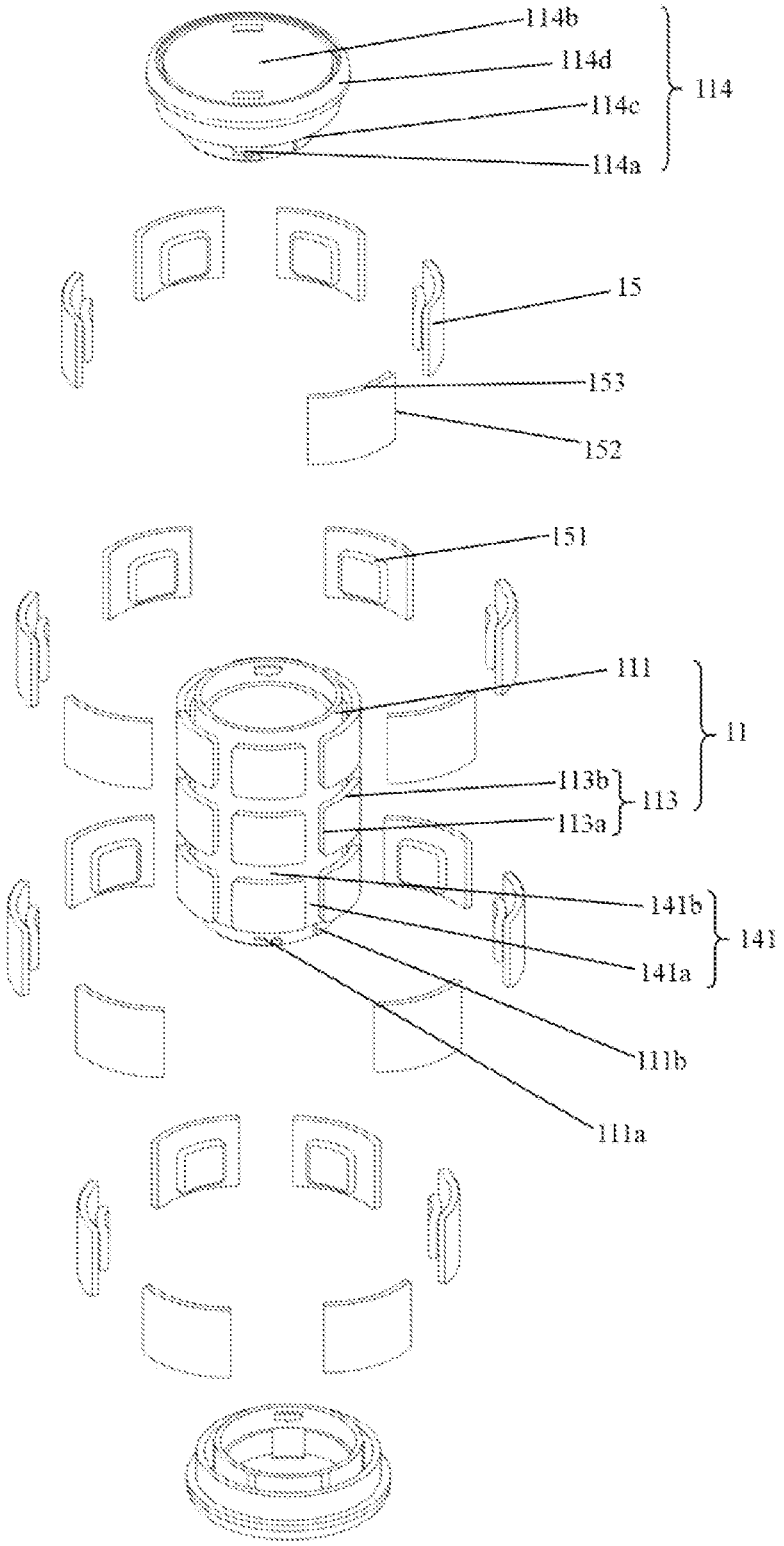
FIG. 3 is an exploded diagram of the sliding puzzle shown in FIG. 1.

As shown in FIG. 1 to FIG. 3, Embodiment I of the present disclosure provides a sliding puzzle 100, including: a cylindrical support 11, provided with two opposite bottom surfaces 12 and a side surface 13 connected between the two bottom surfaces 12, wherein the side surface 13 is provided with a guide rail structure 14; and a plurality of blocks 15, wherein each of the blocks 15 is mounted on the guide rail structure 14 and can slide along the guide rail structure 14 to change a position.

It can be understood that according to the sliding puzzle 100 of the present disclosure, the guide rail structure 14 is arranged on the cylindrical support 11, and the plurality of blocks 15 slide along the guide rail structure 14 to change the positions. Compared with the sliding puzzle 100 in the prior art, which is assembled by fixing the plurality of blocks 15 to a surface of a main body seat one by one through buckles or in a magnetic suction manner, the sliding puzzle 100 in this solution can effectively decrease the possibility of loss of block parts in an assembling process of the sliding puzzle and improves the convenience of use of the sliding puzzle 100. Meanwhile, compared with the paper card type and plastic sliding puzzles 100, the sliding puzzle 100 in this solution improves the stereo perception and the funniness. Furthermore, the plurality of blocks 15 and the cylindrical support 11 are only connected through the guide rail structure 14, so that the sliding puzzle is simple in structure, convenient to assemble, and connected firmly. The sliding puzzle 100 can be made of a plastic material, such as ABS, POM, PS, PMMA, PC, and PET, so as to reduce the mass of the cylindrical support 11 to facilitate carrying.

During use of the sliding puzzle 100, a partial assembling pattern for forming a complete assembled pattern is formed on a surface of each of the blocks 15 facing away from the guide rail structure 14. A user pushes the blocks 15 to slide relative to the cylindrical support 11, so that when the respective blocks 15 slide to preset positions, the partial assembling patterns on the respective blocks 15 can be assembled into the complete assembled pattern. The complete assembled pattern can be in one pattern form or two or more pattern forms, so as to improve the diversity of assembling of the blocks 15. The assembling patterns can be attached to the blocks 15 by carriers printed with the patterns through glue, so as to simplify its connection structure with the blocks 15 and ensure the stability of fixing of the assembling patterns. On the other hand, the assembling patterns can also be fixed to the blocks 15 by carriers printed with patterns through magnetic suction. In this way, when the funniness is reduced after the sliding puzzle 100 is used for a long time, there is no need to replace the entire sliding puzzle 100, and the assembling patterns of the blocks 15 can change only by replacing the carriers printed with different patterns on the blocks 15. The magnetic suction fixation can simplify the mounting and removal processes of the carriers and the blocks, and improve the convenience of the assembling pattern replacement process.

Figure 5:
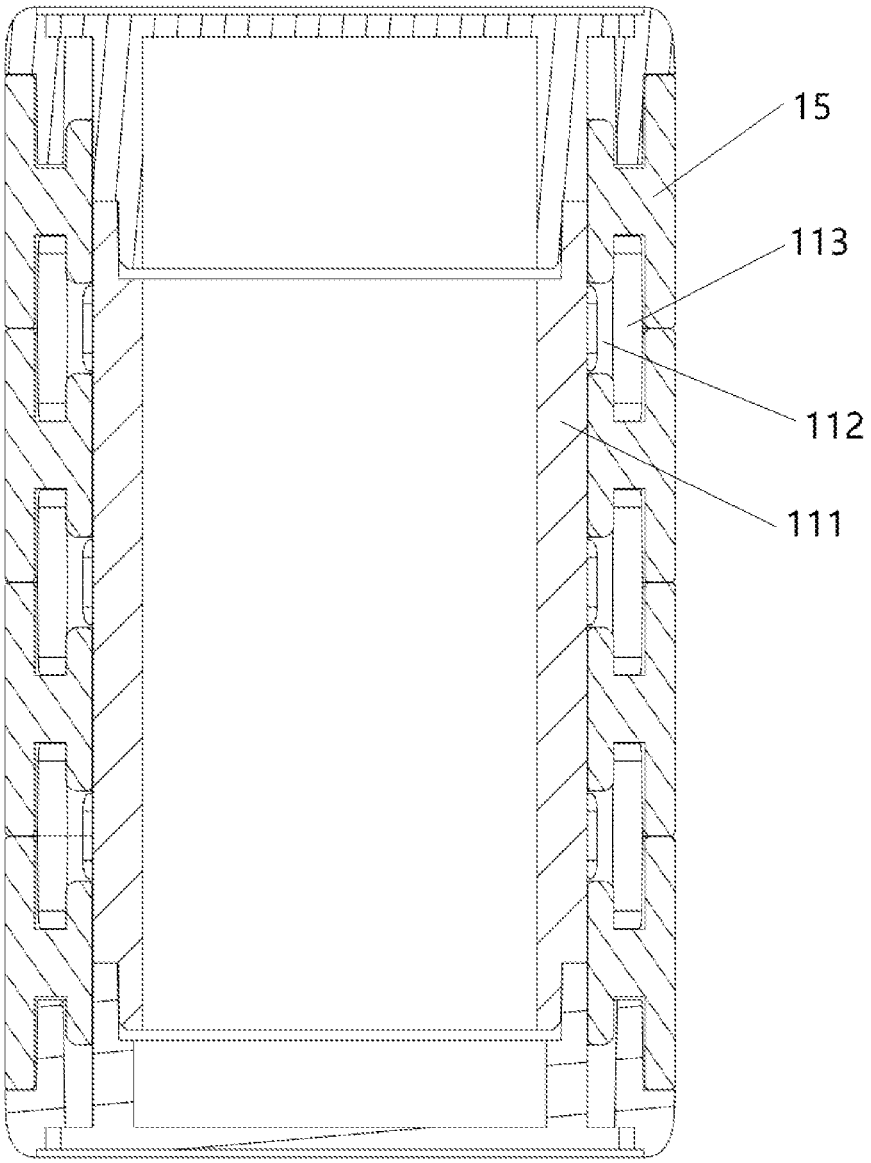
FIG. 5 is a cross-sectional view of the sliding puzzle shown in FIG. 1 in another angle.

Further, as shown in FIG. 5, the guide rail structure 14 includes chutes 141; the cylindrical support 11 includes a support main body 111, a connecting part 112, and a plurality of curved plates 113; the support main body 111 is a cylindrical body and has an outer circumferential surface with an arc-shaped cross section; the connecting part 112 is connected between the outer circumferential surface and the curved plates 113; the plurality of curved plates 113 are located on an outer side of the outer circumferential surface and protrude towards the outer side of the outer circumferential surface; surfaces, far from the outer circumferential surface, of the plurality of curved plates 113 define the side surface 13, and the chutes 141 are located between two adjacent curved plates 113; each block 15 includes a block part 154 and a sliding part 155 connected to one side of the block part 154 close to the cylindrical support 11; and the sliding part 155 is at least partially located in the chute 141 and slides along the chute 141. It can be understood that the cylindrical support 11 includes the support main body 111, the connecting part 112, and the plurality of curved plates 113, so that the cylindrical support 11 can be independently and separately manufactured during early production, thereby facilitating respective molding in production process and improving the convenience of production and manufacturing of the cylindrical support 11. In case of a damage in a later stage, respective damaged components can be removed for replacement to avoid replacement of the entire toy due to the local damage. Meanwhile, the support main body 111 is a cylindrical body, which also facilitates a user to operate the sliding puzzle 100 with one hand.

Figure 4:
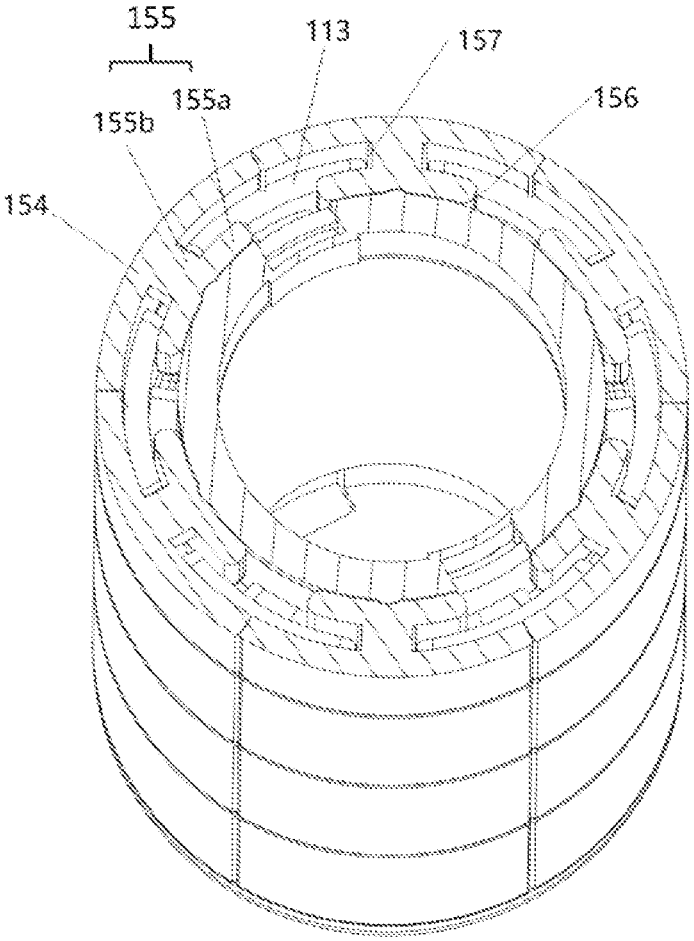
FIG. 4 is a cross-sectional view of the sliding puzzle shown in FIG. 1.

Further, as shown in FIG. 4, the sliding parts 155 are provided with sliding slots 151; and the curved plates 113 are at least partially mounted in the sliding slots 151, so that the blocks 15 can slide along the curved plates 113 and change the positions. It can be understood that only by cooperation between the sliding slots 151 and the curved plates 113, the blocks 15 can slide correspondingly on the guide rail structure 14, thereby improving the convenience of assembling and disassembling and the flexibility of sliding of the sliding puzzle 100. The curved plates 113 are at least partially mounted in the sliding slots 151, without any fasteners and mounting holes, which further simplifies the assembling process and also facilitates smooth sliding of the blocks 15 on the guide rail structure 14, so that it is very flexible for a pushing operation. Meanwhile, the blocks 15 and the curved plates 113 are detachably connected, so that when the blocks 15 are damaged and need to be replaced, the curved plates 113 can be removed for replacement. This avoids such the phenomenon that the entire sliding puzzle 100 needs to be replaced due to the local damage of the blocks 15, thus reducing the cost of replacement of the sliding puzzle 100.

Further, each sliding part 155 includes a first portion 155*a* and a second portion 155*b*; the first portion 155*a* is located on one side of the block part 154 close to the cylindrical support 11 and is opposite to the block part 154; the second portion 155*b* is connected between the block part 154 and the first portion 155*a*; and the first portion 155*a*, the block part 154, and the second portion 155*b* are enclosed to form the sliding slot 151 located between the block part 154 and the first portion 155*a*. An extending slot communicated with the chute 141 is further formed between each curved plate 113 and the outer circumferential surface; the first portion 155*a* is located in the extending slot; the connecting part 112 is connected to a middle region of the curved plate 113; the second portion 155*b* is connected to a middle region of the block part 154 and a middle region of the first portion 155*a*; the block part 154 is in a curved plate shape protruding towards one side far from the cylindrical support 11; the first portion 155*a* is in a curved plate shape protruding towards one side far from the block part 154; a size of the first portion 155*a* is smaller than a size of the block part 154; a size of the curved plate 113 is larger than the size of the first portion 155*a* and smaller than the size of the block part 154; a first gap 156 is reserved between the first portion 155*a* and the connecting part 112; and a second gap 157 is reserved between the curved plate 113 and the second portion 155*b*. It can be understood that the arrangement of the extending slots reduces a frictional force formed by relative sliding between the blocks 15 and the chute 141 and can improve the smoothness of movement of the blocks 15.

Further, the plurality of curved plates 113 are arranged in an array; the chutes 141 include a plurality of first chutes 141*a* parallel to a central axis of the cylindrical support 11 and a plurality of second chutes 141*b* vertically intersected with the first chutes 141*a* and annularly arranged along the side surface of the cylindrical support 11. It can be understood that the curved plates 113 are arranged in the array, which simplifies the complexity of the assembling of the blocks 15. Through the arrangement of the first chutes 141*a* and the second chutes 141*b*, a guide effect is achieved on the sliding of the blocks 15, so that a sliding path can be formed along the first chutes 141*a* and the second chutes 141*b*, and the blocks rotate at a periphery of the cylindrical support 11 and moves up, down, left, and right, thus ensuring the stability of the blocks 15 in the sliding process.

Further, the blocks 15 are located on an outer side of the side surface 13 and protrude towards the outer side of the side surface 13; surfaces of the blocks 15 far from the side surface 13 are an arc-shaped surfaces; the sliding puzzle 100 is of a cylindrical structure; and the arc-shaped surfaces of the plurality of blocks 15 are enclosed to form an outer side surface of the cylindrical structure. The plurality of blocks 15 are arranged in an array with a missing part; each block 15 includes two first straight edges 152 which extend in a direction where the first chute 141*a* is located and are arranged in a manner of being opposite to each other, and first arc-shaped edges 153 which extend in a direction where the second chute 141*b* is located and are arranged in a manner of being opposite to each other; and each curved plate 113 includes two second straight edges 113*a* which extend in the direction where the first chute 141*a* is located and are arranged in a manner of being opposite to each other, and second arc-shaped edges 113*b* which extend in the direction where the second chute 141*b* is located and are arranged in a manner of being opposite to each other. It can be understood that the first straight edges 152 of the blocks 15 are matched with the second straight edges 113*a* of the curved plates 113, and the first arc-shaped edges 153 of the blocks 15 are matched with the second arc-shaped edges 113*b* of the curved plates 113. This arrangement can enlarge an abutment area between the blocks 15 and the curved plates 113, thereby improving the stability of connection between the blocks 15 and the curved plates 113 and further reducing the possibility that the blocks 15 are separated from the cylindrical support 11 because the blocks 15 are separated from the curved plates 113 during the use of the sliding puzzle 100. The blocks 15 can be arranged in six rows and four columns, six rows and five columns, or the like on the cylindrical support 11, and there is one block missing in a certain row or column to form an avoidance space, so that during use of the sliding puzzle 100, the block 15 adjacent to the avoidance space can slide into the avoidance space.

Further, distances between the plurality of first chutes 141*a* are equal; distances between the plurality of second chutes 141*b* are equal; the plurality of blocks 15 have same sizes; the plurality of curved plates 113 have same sizes; the size of the block 15 is greater than the size of the curved plate 113; the plurality of first chutes 141*a* have same sizes; the plurality of second chutes 141*b* have same sizes; and widths of the plurality of first chutes 141*a* are equal to widths of the plurality of second chutes 141*b*.

Further, the cylindrical support 11 further includes mounting covers 114 mounted on two sides of the support main body 111; the mounting covers 114 are provided with first detachable structures 114*a*; the support main body 111 is provided with a second detachable structure 111*a*; and the first detachable structures 114*a* are detachably connected to the second detachable structure 111*a*, so that the mounting covers 114 are detachably connected to the support main body 111 into a whole. It can be understood that due to the design of the mounting covers 114, the blocks 15 can slide on the support main body 111 without sliding out, which maintains the overall stability of the sliding puzzle 100, and the mounting covers 114 are detachably connected to the support main body 111, which facilitates later production and repair.

Further, each mounting cover 114 includes a circular substrate 114*b*, a first side wall part 114*c* connected to one side of the substrate 114*b* and arranged around the central axis of the cylindrical support 11, and a second side wall part 114*d* connected to one side of the substrate 114*b*, arranged around the first side wall part 114*c*, and spaced part from the first side wall part 114*c*; an inner surface of the first side wall part 114*c* is provided with the first detachable structure 114*a*; the support main body 111 includes a third side wall part 111*b* arranged around the central axis of the cylindrical support 11; and an outer surface of the third side wall part 111*b* is provided with the second detachable structure 111*a*.

Further, the support main body 111 is of a hollow structure; the curved plates 113 close to the mounting covers 114 are located in a space between the first side wall parts 114*c* and the second side wall parts 114*d*; outer diameters of the second side wall parts 114*d* are less than a diameter of the substrate 114*b*, so that a surface of one side of the substrate 114*b* close to the support main body 111 and outer surfaces of the second side wall parts 114*d* are enclosed into stepped storage parts; and the blocks 15 close to the mounting covers 114 are located in the storage parts. It can be understood that the support main body 111 is of the hollow structure, which can reduce the mass of the support main body 111 and make it easy for the user to carry, and can also reduce use of production materials to reduce the manufacturing cost.

Embodiment II

Figure 6:
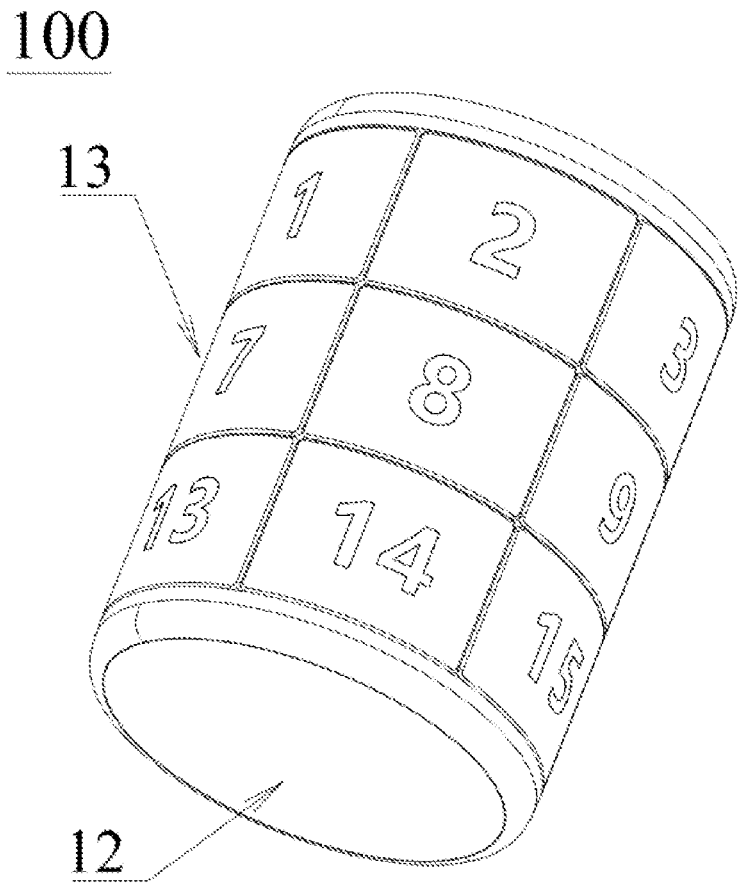
FIG. 6 is a three-dimensional diagram of a sliding puzzle according to Embodiment II of the present disclosure.
Figure 7:
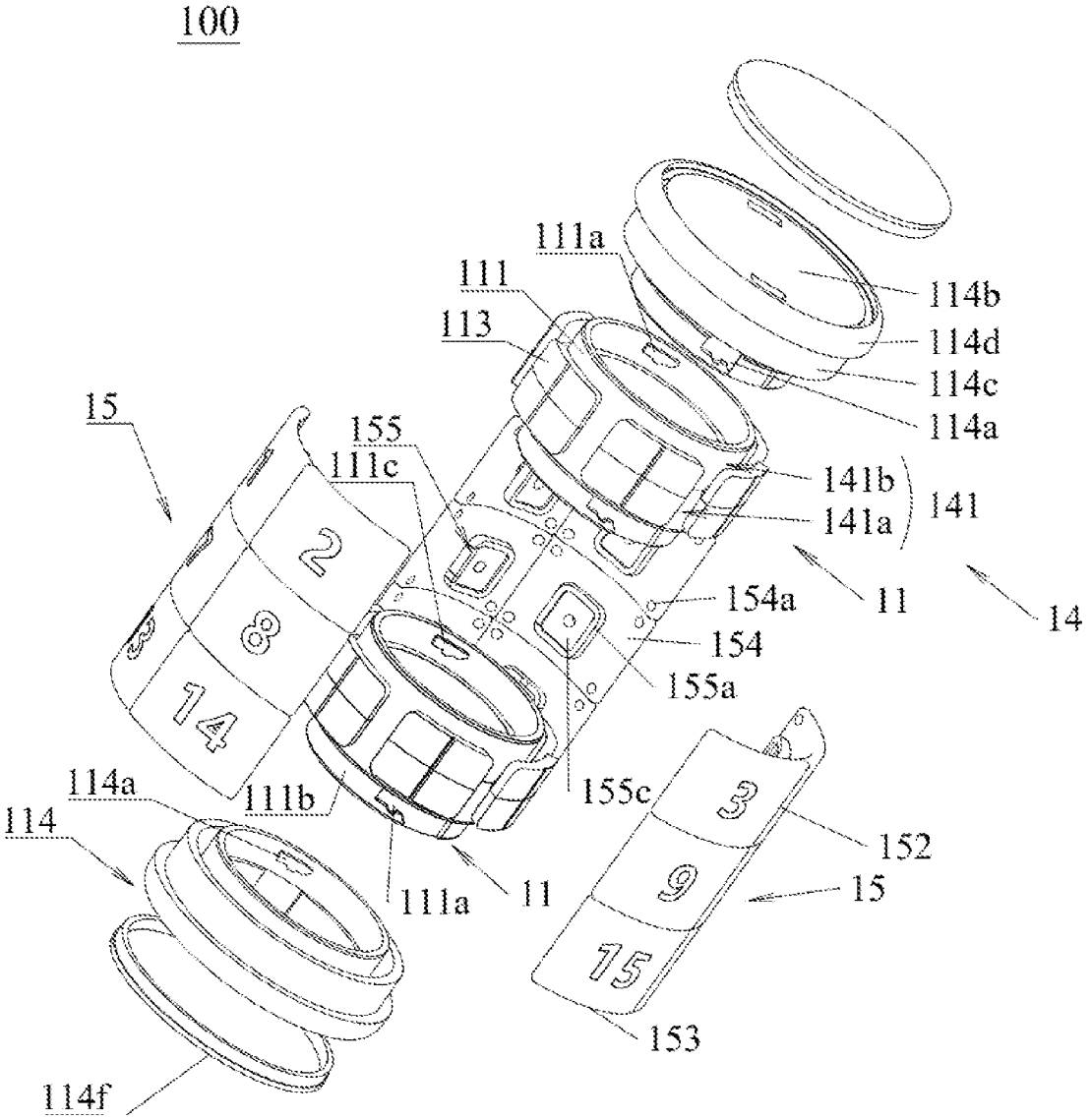
FIG. 7 is an exploded diagram of the sliding puzzle shown in FIG. 6.

As shown in FIG. 6 to FIG. 7, Embodiment II of the present disclosure provides a sliding puzzle 100, including: a cylindrical support 11, provided with two opposite bottom surfaces 12 and a side surface 13 connected between the two bottom surfaces 12, wherein the side surface 13 is provided with a guide rail structure 14; and a plurality of blocks 15, wherein each of the blocks 15 is mounted on the guide rail structure 14 and can slide along the guide rail structure 14 to change a position. In order to facilitate assembling of the sliding puzzle 100 in a production process, in Embodiment II, the cylindrical support 11 is divided into two sub-supports of same structures, and the two sub-supports are assembled into the complete cylindrical support 11 by detachable connection. It can be understood that after the cylindrical support 11 is divided into the two sub-supports, each sub-support has a side surface 13 and a guide rail structure 14 on the side surface, as well as a plurality of blocks 15. After the two sub-supports are detachably connected with each other, the guide rail structures 14 on the respective sub-supports can also be connected together, and each block 15 can slide and change the position on the guide rail structure 14. The function of the cylindrical support 11 formed by the detachable connection and the functions of the components on the cylindrical support remain unchanged. Specifically, the two sub-supports are of cylindrical structures; and the sub-supports are connected in a direction where the central axis of the cylindrical support 11 is located to form the cylindrical support 11. The respective sub-supports have the same structures. Due to the design of the sub-supports having the same structures, the production is facilitated, and differentiation is not required during assembling, thereby improving the production efficiency and assembling efficiency and reducing the production cost of a product. It can be understood that Embodiment I, the cylindrical support 11 can also be divided into three or four or more sub-supports, and the structure of each sub-support can be the same or different, as long as the function of the cylindrical support 11 can be achieved after the sub-supports are assembled.

It can be understood that according to the sliding puzzle 100 of the present disclosure, the cylindrical support 11 is divided into the two sub-supports; the guide rail structures 14 are arranged on the sub-supports; and the plurality of blocks 15 slide along the guide rail structures 14 to change the positions. Compared with the sliding puzzle 100 in the prior art, the sliding puzzle 100 provided in Embodiment II can effectively reduce a volume of the cylindrical support 11, which facilitates transferring and mounting operations. During assembling, after one sub-support is mounted, the blocks are assembled to the guide rail structure 14; and afterwards, the sub-supports and the blocks are repeatedly assembled. As the sub-supports are diminished, the guide rail structures 14 also change, which avoids long-distance sliding and arrangement of the blocks on the guide rail structures 14 during the assembling, thus improving the assembling efficiency of the blocks and effectively reducing the production cost of the product. The sliding puzzle 100 can be made of a plastic material, such as ABS, POM, PS, PMMA, PC, and PET, so as to reduce the mass to facilitate carrying.

During use of the sliding puzzle 100, a partial assembling pattern for forming a complete assembled pattern is formed on a surface of each of the blocks 15 facing away from the guide rail structure 14. A user pushes the blocks 15 to slide relative to the cylindrical support 11, so that when the respective blocks 15 slide to preset positions, the partial assembling patterns on the respective blocks 15 can be assembled into the complete assembled pattern. The complete assembled pattern can be in one pattern form or two or more pattern forms, so as to improve the diversity of assembling of the blocks 15. The assembling patterns can be attached to the blocks 15 by carriers printed with the patterns through glue, so as to simplify its connection structure with the blocks 15 and ensure the stability of fixing of the assembling patterns. On the other hand, the assembling patterns can also be fixed to the blocks 15 by carriers printed with patterns through magnetic suction. In this way, when the funniness is reduced after the sliding puzzle 100 is used for a long time, there is no need to replace the entire sliding puzzle 100, and the assembling patterns of the blocks 15 can change only by replacing the carriers printed with different patterns on the blocks 15. The magnetic suction fixation can simplify the mounting and removal processes of the carriers and the blocks, and improve the convenience of the assembling pattern replacement process.

Figure 8:
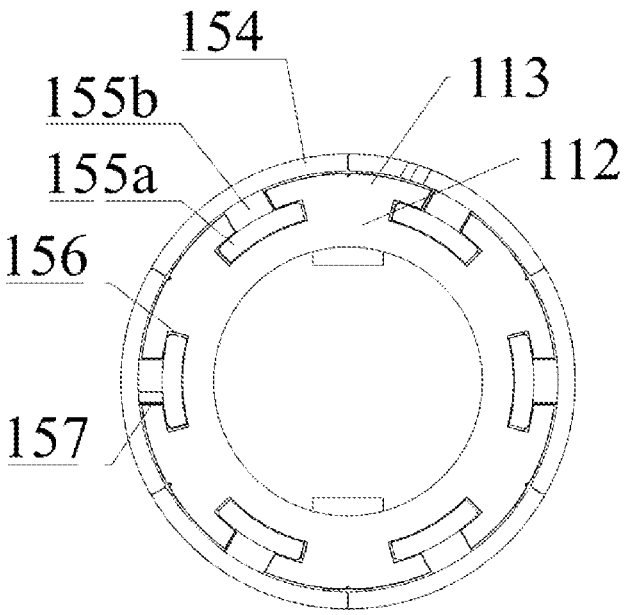
FIG. 8 is a cross-sectional view of the sliding puzzle shown in FIG. 6.
Figure 9:
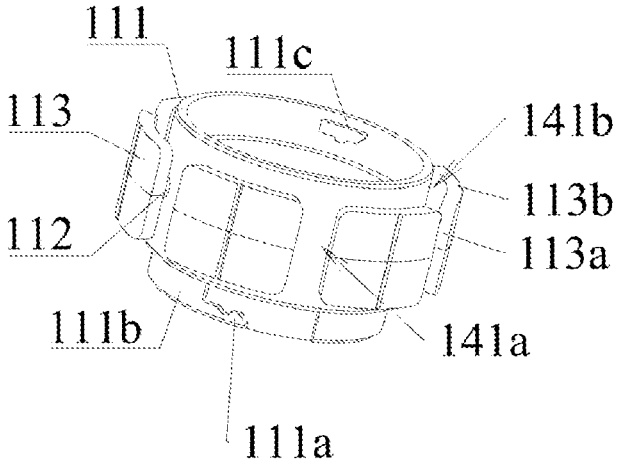
FIG. 9 is a three-dimensional diagram of a sub-support of the sliding puzzle shown in FIG. 6.
Figure 10:
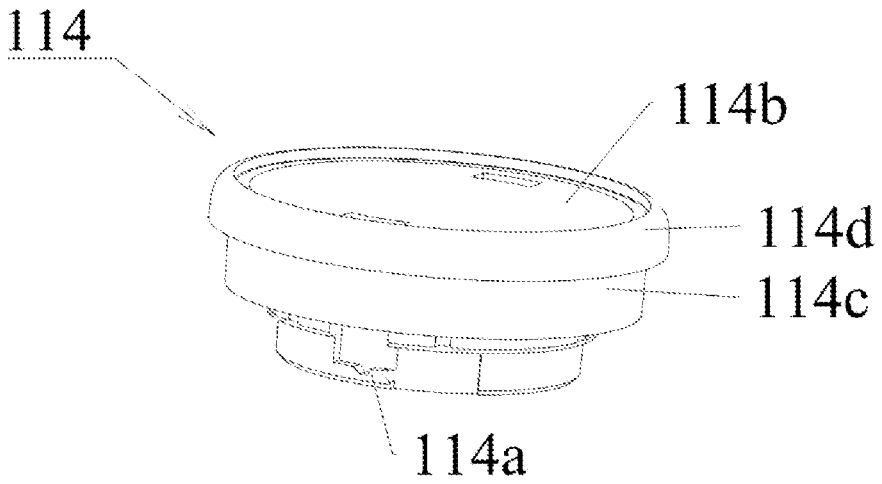
FIG. 10 is a three-dimensional diagram of a mounting cover of the sliding puzzle shown in FIG. 6.
Figure 11:
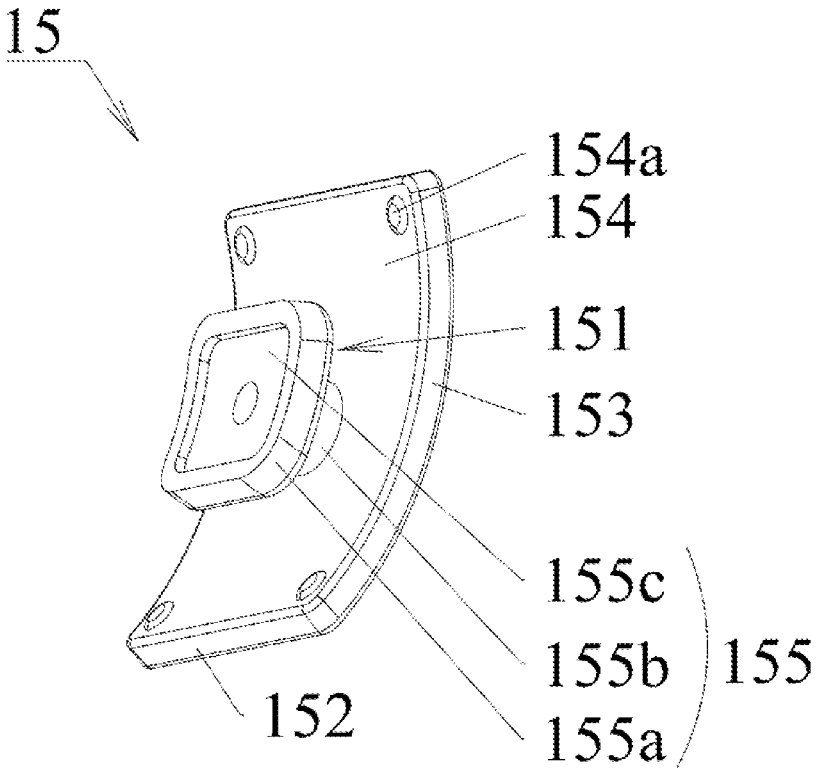
FIG. 11 is a three-dimensional diagram of a block of the sliding puzzle shown in FIG. 6.

Further, as shown in FIG. 7 to FIG. 9, the guide rail structure 14 includes chutes 141; each sub-support includes a support main body 111, a connecting part 112, and a plurality of curved plates 113; the support main body 111 is a cylindrical body and has an outer circumferential surface with an arc-shaped cross section; the connecting part 112 is connected between the outer circumferential surface and the curved plates 113; the plurality of curved plates 113 are located on an outer side of the outer circumferential surface and protrude towards the outer side of the outer circumferential surface; surfaces, far from the outer circumferential surface, of the plurality of curved plates 113 define the side surface 13, and the chutes 141 are located between two adjacent curved plates 113; each block 15 includes a block part 154 and a sliding part 155 connected to one side of the block part 154 close to the sub-support; and the sliding part 155 is at least partially located in the chute 141 and slides along the chute 141. It can be understood that the sub-support includes the support main body 111, the connecting part 112, and the plurality of curved plates 113, so that the sub-support can be independently and separately manufactured during early production, thereby facilitating respective molding in production process and improving the convenience of production and manufacturing of the sub-support. In case of a damage in a later stage, respective damaged components can be removed for replacement to avoid replacement of the entire toy due to the local damage. Meanwhile, the support main body 111 is a cylindrical body, which also facilitates a user to operate the sliding puzzle 100 with one hand.

Further, as shown in FIG. 7 to FIG. 11, the sliding parts 155 are provided with sliding slots 151; and the curved plates 113 are at least partially mounted in the sliding slots 151, so that the blocks 15 can slide along the curved plates 113 and change the positions. It can be understood that only by cooperation between the sliding slots 151 and the curved plates 113, the blocks 15 can slide correspondingly on the guide rail structure 14, thereby improving the convenience of assembling and disassembling and the flexibility of sliding of the sliding puzzle 100. The curved plates 113 are at least partially mounted in the sliding slots 151, without any fasteners and mounting holes, which further simplifies the assembling process and also facilitates smooth sliding of the blocks 15 on the guide rail structure 14, so that it is very flexible for a pushing operation. Meanwhile, the blocks 15 and the curved plates 113 are detachably connected, so that when the blocks 15 are damaged and need to be replaced, the curved plates 113 can be removed for replacement. This avoids such the phenomenon that the entire sliding puzzle 100 needs to be replaced due to the local damage of the blocks 15, thus reducing the cost of replacement of the sliding puzzle 100.

Further, each sliding part 155 includes a first portion 155*a* and a second portion 155*b*; the first portion 155*a* is located on one side of the block part 154 close to the sub-support and is opposite to the block part 154; the second portion 155*b* is connected between the block part 154 and the first portion 155*a*; and the first portion 155*a*, the block part 154, and the second portion 155*b* are enclosed to form the sliding slot 151 located between the block part 154 and the first portion 155*a*. An extending slot communicated with the chute 141 is further formed between each curved plate 113 and the outer circumferential surface; the first portion 155*a* is located in the extending slot; the connecting part 112 is connected to a middle region of the curved plate 113; the second portion 155*b* is connected to a middle region of the block part 154 and a middle region of the first portion 155*a*; the block part 154 is in a curved plate shape protruding towards one side far from the sub-support; the first portion 155*a* is in a curved plate shape protruding towards one side far from the block part 154; a size of the first portion 155*a* is smaller than a size of the block part 154; a size of the curved plate 113 is larger than the size of the first portion 155*a* and smaller than the size of the block part 154; a first gap 156 is reserved between the first portion 155*a* and the connecting part 112; and a second gap 157 is reserved between the curved plate 113 and the second portion 155*b*. It can be understood that the arrangement of the extending slots reduces a frictional force formed by relative sliding between the blocks 15 and the chute 141 and can improve the smoothness of movement of the blocks 15.

Further, each sliding part 155 is provided with a groove 155*c* on a surface close to the sub-support of the cylindrical support 11; each block part 154 is provided with a plurality of convex blocks 154*a* on one side close to the sub-support; and the respective convex blocks 154*a* are respectively adjacent to four corners of the block part 154. The groove 155*c* is arranged on the surface of the sliding part 155, which can achieve a certain gap between the sliding part 155 and the sub-support, reduce the friction, and facilitate the sliding of the sliding part 155. Meanwhile, the convex blocks 154*a* are arranged on the block part 154, which can add a gap from the curved plate 113 and reduce a contact area, thereby reducing the friction, facilitating the sliding of the sliding part 155, and improving the experience.

Further, the plurality of curved plates 113 are arranged in an array; the chutes 141 include a plurality of first chutes 141*a* parallel to a central axis of the sub-support and a plurality of second chutes 141*b* vertically intersected with the first chutes 141*a* and annularly arranged along the side surface of the sub-support. It can be understood that the curved plates 113 are arranged in the array, which simplifies the complexity of the assembling of the blocks 15. Through the arrangement of the first chutes 141*a* and the second chutes 141*b*, a guide effect is achieved on the sliding of the blocks 15, so that a sliding path can be formed along the first chutes 141*a* and the second chutes 141*b*, and the blocks rotate at a periphery of the sub-support and moves up, down, left, and right, thus ensuring the stability of the blocks 15 in the sliding process.

Further, the blocks 15 are located on an outer side of the side surface 13 and protrude towards the outer side of the side surface 13; surfaces of the blocks 15 far from the side surface 13 are an arc-shaped surfaces; the sliding puzzle 100 is of a cylindrical structure; and the arc-shaped surfaces of the plurality of blocks 15 are enclosed to form an outer side surface of the cylindrical structure. The plurality of blocks 15 are arranged in an array; each block 15 includes two first straight edges 152 which extend in a direction where the first chute 141*a* is located and are arranged in a manner of being opposite to each other, and first arc-shaped edges 153 which extend in a direction where the second chute 141*b* is located and are arranged in a manner of being opposite to each other;

and each curved plate 113 includes two second straight edges 113*a* which extend in the direction where the first chute 141*a* is located and are arranged in a manner of being opposite to each other, and second arc-shaped edges 113*b* which extend in the direction where the second chute 141*b* is located and are arranged in a manner of being opposite to each other. It can be understood that the first straight edges 152 of the blocks 15 are matched with the second straight edges 113*a* of the curved plates 113, and the first arc-shaped edges 153 of the blocks 15 are matched with the second arc-shaped edges 113*b* of the curved plates 113. This arrangement can enlarge an abutment area between the blocks 15 and the curved plates 113, thereby improving the stability of connection between the blocks 15 and the curved plates 113 and further reducing the possibility that the blocks 15 are separated from the sub-support because the blocks 15 are separated from the curved plates 113 during the use of the sliding puzzle 100. The blocks 15 can be arranged in three rows and six columns, three rows and five columns, or the like on the cylindrical support 11.

Further, distances between the plurality of first chutes 141*a* are equal; distances between the plurality of second chutes 141*b* are equal; the plurality of blocks 15 have same sizes; the plurality of curved plates 113 have same sizes; the size of the block 15 is greater than the size of the curved plate 113; the plurality of first chutes 141*a* have same sizes; the plurality of second chutes 141*b* have same sizes; and widths of the plurality of first chutes 141*a* are equal to widths of the plurality of second chutes 141*b*.

Further, the sub-support further includes mounting covers 114 mounted on two sides of the support main body 111; the mounting covers 114 are provided with first detachable structures 114*a*; the support main body 111 is provided with a second detachable structure 111*a*; and the first detachable structures 114*a* are detachably connected to the second detachable structure 111*a*, so that the mounting covers 114 are detachably connected to the support main body 111 into a whole. It can be understood that due to the design of the mounting covers 114, the blocks 15 can slide on the support main body 111 without sliding out, which maintains the overall stability of the sliding puzzle 100, and the mounting covers 114 are detachably connected to the support main body 111, which facilitates later production and repair.

Further, each mounting cover 114 includes a circular substrate 114*b*, a first side wall part 114*c* connected to one side of the substrate 114*b* and arranged around the central axis of the sub-support, and a second side wall part 114*d* connected to one side of the substrate 114*b*, arranged around the first side wall part 114*c*, and spaced part from the first side wall part 114*c*; the first side wall part 114*c* is provided with the first detachable structure 114*a*; the support main body 111 includes a third side wall part 111*b* arranged around the central axis of the sub-support; and the third side wall part 111*b* is provided with the second detachable structure 111*a*.

Further, the first detachable structures 114*a* and the second detachable structure 111*a* detachably cooperate with each other to connect the mounting covers 114 to the sub-support. The support main body 111 is of a hollow structure; the curved plates 113 close to the mounting covers 114 are located in a space between the first side wall parts 114*c* and the second side wall parts 114*d*; outer diameters of the second side wall parts 114*d* are less than a diameter of the substrate 114*b*, so that a surface of one side of the substrate 114*b* close to the support main body 111 and outer surfaces of the second side wall parts 114*d* are enclosed into stepped storage parts; and the blocks 15 close to the mounting covers 114 are located in the storage parts. Each mounting cover 114 further includes a decorative plate 114*f*; and the decorative plate 114*f* is covered at one end of the second side wall part 114*d* far from the support main body 111 to cover the substrate 114*b*. It can be understood that the support main body 111 is of the hollow structure, which can reduce the mass of the support main body 111 and make it easy for the user to carry, and can also reduce use of production materials to reduce the manufacturing cost. Through the arrangement of the decorative plate 114*f*, the substrate 114*b* can be covered, so that the product has a more beautiful appearance, and debris can be effectively prevented from entering the product.

Specifically, a quantity of the mounting covers 114 is two, and the two mounting covers 114 are detachably connected to two opposite ends of the two sub-supports. The second detachable structures 111*a* are arranged at first ends of the two sub-supports of the cylindrical support 11 close to the two mounting covers 114; third detachable structures 111*c* are further arranged at ends of the respective sub-supports that are close to each other; the third detachable structures 111*c* of two adjacent sub-supports are detachably matched with each other to connect the respective sub-supports to form the cylindrical support 11. The first detachable structures 114*a*, the second detachable structures 111*a*, and the third detachable structures 111*c* are all rotating detachable structures. In order to align the surface of the cylindrical support 11 formed by the detachable connection of the respective sub-supports, an outer diameter of a barrel-shaped structure surrounded by a side wall where the third detachable structure 111*c* arranged on the support main body 111 of one of the two adjacent sub-supports is small, that is, the two third detachable structures 111*c* of the two adjacent sub-supports are respectively located on an outer side and an inner side of the respective support main bodies 111, to form detachably connected structures. It can be understood that through the arrangement of the third detachable structures 111*c*, the two sub-supports can be connected to obtain the cylindrical support 11; and the assembling and disassembling are simple and convenient, thereby improving the assembling efficiency of the product, effectively reducing the production cost, and improving the competitiveness of the product.

The various technical features in the foregoing embodiments may be randomly combined. For concise description, not all possible combinations of the various technical features in the above embodiments are described. However, provided that combinations of these technical features do not conflict with each other, the combinations of the various technical features are considered as falling within the scope of this specification. The foregoing embodiments merely express several implementations of the present disclosure. The descriptions thereof are relatively specific and detailed, but are not understood as limitations on the scope of the present disclosure. A person of ordinary skill in the art can also make several transformations and improvements without departing from the idea of this application. These transformations and improvements fall within the protection scope of this application. Therefore, the protection scope of the patent of this application shall be subject to the appended claims.

What is claimed is:

1. A sliding puzzle, wherein the sliding puzzle comprises:

a cylindrical support, provided with two opposite bottom surfaces and a side surface connected between the two bottom surfaces, wherein the side surface is provided with a guide rail structure; and a plurality of blocks, wherein each of the blocks is mounted on the guide rail structure and slides along the guide rail structure to change a position, wherein the guide rail structure comprises chutes; the cylindrical support comprises a support main body, a connecting part, and a plurality of curved plates; the support main body is a cylindrical body and has an outer circumferential surface with an arc-shaped cross section; the connecting part is connected between the outer circumferential surface and the curved plates; the plurality of curved plates are located on an outer side of the outer circumferential surface and protrude towards the outer side of the outer circumferential surface; surfaces, far from the outer circumferential surface, of the plurality of curved plates define the side surface, and the chutes are located between two adjacent curved plates; each block comprises a block part and a sliding part connected to one side of the block part close to the cylindrical support; and the sliding part is at least partially located in the chute and slides along the chute, wherein the plurality of curved plates are arranged in an array; the chutes comprise a plurality of first chutes parallel to a central axis of the cylindrical support and a plurality of second chutes vertically intersected with the first chutes and annularly arranged along the side surface of the cylindrical support.

2. The sliding puzzle according to claim 1, wherein the sliding parts are provided with sliding slots; and the curved plates are at least partially mounted in the sliding slots, so that the blocks slide along the curved plates and change the positions.

3. The sliding puzzle according to claim 2, wherein each sliding part comprises a first portion and a second portion; the first portion is located on one side of the block part close to the cylindrical support and is opposite to the block part; the second portion is connected between the block part and the first portion; and the first portion, the block part, and the second portion are enclosed to form the sliding slot located between the block part and the first portion.

4. The sliding puzzle according to claim 3, wherein an extending slot communicated with the chute is further formed between each curved plate and the outer circumferential surface; the first portion is located in the extending slot; the connecting part is connected to a middle region of the curved plate; the second portion is connected to a middle region of the block part and a middle region of the first portion; the block part is in a curved plate shape protruding towards one side far from the cylindrical support; the first portion is in a curved plate shape protruding towards one side far from the block part; a size of the first portion is smaller than a size of the block part; a size of the curved plate is larger than the size of the first portion and smaller than the size of the block part; a first gap is reserved between the first portion and the connecting part; and a second gap is reserved between the curved plate and the second portion.

5. The sliding puzzle according to claim 1, wherein the block parts are located on an outer side of the side surface and protrude towards the outer side of the side surface; surfaces of the block parts far from the side surface are an arc-shaped surfaces; the sliding puzzle is of a cylindrical structure; and the arc-shaped surfaces of the plurality of block parts are enclosed to form an outer side surface of the cylindrical structure.

6. The sliding puzzle according to claim 1, wherein the plurality of blocks are arranged in an array; each block comprises two first straight edges which extend in a direction where the first chute is located and are arranged in a manner of being opposite to each other, and first arc-shaped edges which extend in a direction where the second chute is located and are arranged in a manner of being opposite to each other; and each curved plate comprises two second straight edges which extend in the direction where the first chute is located and are arranged in a manner of being opposite to each other, and second arc-shaped edges which extend in the direction where the second chute is located and are arranged in a manner of being opposite to each other.

7. The sliding puzzle according to claim 6, wherein the plurality of blocks are arranged in an array with a space.

8. The sliding puzzle according to claim 1, wherein distances between the plurality of first chutes are equal; distances between the plurality of second chutes are equal; the plurality of blocks have same sizes; the plurality of curved plates have same sizes; the size of the block is greater than the size of the curved plate; the plurality of first chutes have same sizes; the plurality of second chutes have same sizes; and widths of the plurality of first chutes are equal to widths of the plurality of second chutes.

9. The sliding puzzle according to claim 1, wherein the cylindrical support further comprises mounting covers mounted on two sides of the support main body; the mounting covers are provided with first detachable structures; the support main body is provided with a second detachable structure; and the first detachable structures are detachably connected to the second detachable structure, so that the mounting covers are detachably connected to the support main body into a whole.

10. The sliding puzzle according to claim 9, wherein a quantity of the mounting covers is two, and the two mounting covers are detachably connected to two ends of the cylindrical support.

11. A sliding puzzle, wherein the sliding puzzle comprises:

a cylindrical support, provided with two opposite bottom surfaces and a side surface connected between the two bottom surfaces, wherein the side surface is provided with a guide rail structure; and a plurality of blocks, wherein each of the blocks is mounted on the guide rail structure and slides along the guide rail structure to change a position, wherein the guide rail structure comprises chutes; the cylindrical support comprises a support main body, a connecting part, and a plurality of curved plates; the support main body is a cylindrical body and has an outer circumferential surface with an arc-shaped cross section; the connecting part is connected between the outer circumferential surface and the curved plates; the plurality of curved plates are located on an outer side of the outer circumferential surface and protrude towards the outer side of the outer circumferential surface; surfaces, far from the outer circumferential surface, of the plurality of curved plates define the side surface, and the chutes are located between two adjacent curved plates; each block comprises a block part and a sliding part connected to one side of the block part close to the cylindrical support; and the sliding part is at least partially located in the chute and slides along the chute, wherein the cylindrical support further comprises mounting covers mounted on two sides of the support main body; the mounting covers are provided with first detachable structures; the support main body is provided with a second detachable structure; and the first detachable structures are detachably connected to the second detachable structure, so that the mounting covers are detachably connected to the support main body into a whole, wherein each mounting cover comprises a circular substrate, a first side wall part connected to one side of the substrate and arranged around the central axis of the cylindrical support, and a second side wall part connected to one side of the substrate, arranged around the first side wall part, and spaced part from the first side wall part; the first side wall part is provided with the first detachable structure; the support main body comprises a third side wall part arranged around the central axis of the cylindrical support; and the third side wall part is provided with the second detachable structure.

12. The sliding puzzle according to claim 11, wherein the support main body is of a hollow structure; the curved plates close to the mounting covers are located in a space between the first side wall parts and the second side wall parts; outer diameters of the second side wall parts are less than a diameter of the substrate, so that a surface of one side of the substrate close to the support main body and outer surfaces of the second side wall parts are enclosed into stepped storage parts; and the blocks close to the mounting covers are located in the storage parts.

13. The sliding puzzle according to claim 11, wherein each mounting cover further comprises a decorative plate; and the decorative plate is covered at one end of the second side wall part far from the support main body to cover the substrate.

14. The sliding puzzle according to claim 1, wherein each sliding part is provided with a groove on a surface close to the cylindrical support; each block part is provided with a plurality of convex blocks on one side close to the cylindrical support; and the respective convex blocks are respectively adjacent to four corners of the block part.

15. The sliding puzzle according to claim 1, wherein the cylindrical support comprises at least two sub-supports, and at least two sub-supports are detachably connected with each other to form the cylindrical support.

16. The sliding puzzle according to claim 15, wherein the respective sub-supports have same structures; the sub-supports are of cylindrical structures; and the sub-supports are connected in a direction where the central axis of the cylindrical support is located to form the cylindrical support.

17. The sliding puzzle according to claim 16, wherein the sub-supports are further provided with third detachable structures, and the third detachable structures of two adjacent sub-supports are detachably connected to enable the respective sub-supports to be connected to form the cylindrical support.

18. A sliding puzzle, wherein the sliding puzzle comprises:

a cylindrical support, provided with two opposite bottom surfaces and a side surface connected between the two bottom surfaces, wherein the side surface is provided with a guide rail structure; and a plurality of blocks, wherein each of the blocks is mounted on the guide rail structure and slides along the guide rail structure to change a position, wherein the cylindrical support comprises at least two sub-supports, and at least two sub-supports are detachably connected with each other to form the cylindrical support, wherein the respective sub-supports have same structures; the sub-supports are of cylindrical structures; and the sub-supports are connected in a direction where the central axis of the cylindrical support is located to form the cylindrical support, wherein the sub-supports are further provided with third detachable structures, and the third detachable structures of two adjacent sub-supports are detachably connected to enable the respective sub-supports to be connected to form the cylindrical support, wherein the cylindrical support further comprises two mounting covers respectively mounted on the two sub-supports located at two ends of the cylindrical support; the mounting covers are provided with first detachable structures; second detachable structures are arranged at ends of the two sub-supports close to the mounting covers; the first detachable structures are detachably connected to the second detachable structures, so that the mounting covers and the sub-supports are detachably connected to each other into a whole; and the first detachable structures, the second detachable structures, and the third detachable structures are all rotating buckle structures.

* * * * *